US005162012A

United States Patent [19]

Blandi et al.

[11] Patent Number: 5,162,012

[45] Date of Patent: Nov. 10, 1992

[54] MUSICAL PULL STRING TOY

[75] Inventors: Salvatore Blandi, Farmingdale; Susan S. Gelb, Nyack, both of N.Y.

[73] Assignee: Bantam Collections Inc., New York, N.Y.

[21] Appl. No.: 817,896

[22] Filed: Jan. 7, 1992

[51] Int. Cl.[5] ..... A63H 3/28; A63H 3/36; A63H 3/02; G09F 27/00

[52] U.S. Cl. ..... 446/298; 446/303; 446/320; 446/371; 40/455

[58] Field of Search ..... 446/297, 298, 299, 303, 446/308, 309, 310, 311, 314, 315, 320, 321, 323, 322, 330, 331, 358, 192, 193, 197, 198, 368, 371; 40/455, 414

[56] References Cited

U.S. PATENT DOCUMENTS

| | | | |
|---|---|---|---|
| 99,023 | 1/1870 | Splitdorf | 446/310 |
| 1,062,129 | 5/1913 | Sweeney | 446/310 |
| 2,422,913 | 6/1947 | Leach | 446/310 |
| 2,446,540 | 8/1948 | Leach | 446/310 |
| 2,519,499 | 8/1950 | O'Sullivan et al. | 446/299 |
| 3,261,124 | 7/1966 | Bodenstein | 446/299 |
| 3,490,172 | 1/1970 | Schwartz | 446/298 |
| 4,050,342 | 9/1977 | Suzuki et al. | 446/298 X |
| 4,056,896 | 11/1977 | Karasawa | 446/315 X |
| 4,245,486 | 1/1981 | Matsumoto et al. | 446/314 X |
| 4,626,224 | 12/1986 | Benson et al. | 446/297 |

FOREIGN PATENT DOCUMENTS

| | | | |
|---|---|---|---|
| 389223 | 2/1924 | Fed. Rep. of Germany | 446/310 |
| 810368 | 8/1951 | Fed. Rep. of Germany | 446/320 |
| 2232361 | 12/1990 | United Kingdom | 446/320 |

*Primary Examiner*—D. Neal Muir
*Attorney, Agent, or Firm*—Blum Kaplan

[57] ABSTRACT

A musical pull string toy having a pull string extending from the head through the body that is displaceable under tension between a first predetermined position and a second predetermined position. The music box emits sound when the string is recoiled from a second position to the first position. The toy body is defined by at least two accordion pleats forming a bellows region. The accordion pleats have a substantially symmetric shape and each pleat is substantially concentric around the pull string when the pull string is extended to the second position. Accordingly, the appearance of the pleats is not distorted at all positions of the pull string.

17 Claims, 2 Drawing Sheets

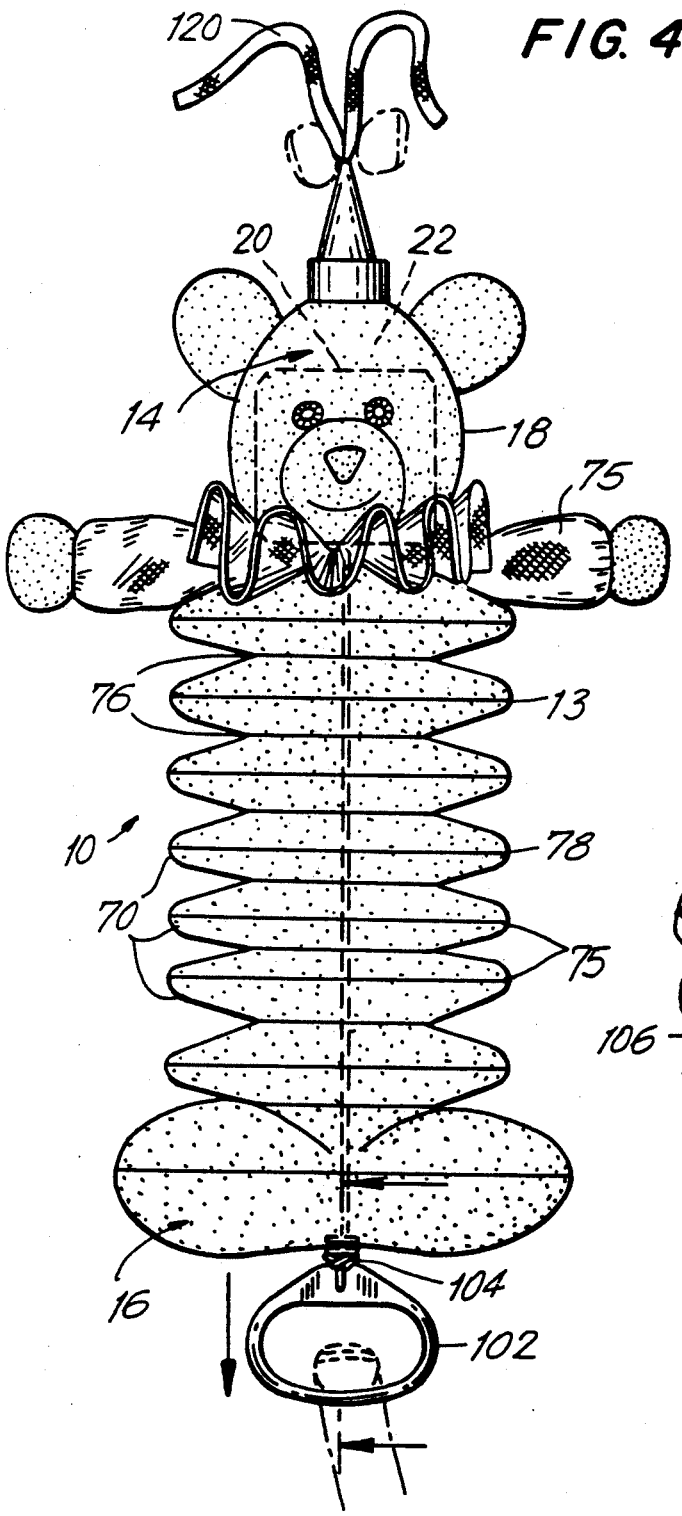
FIG. 4
FIG. 5
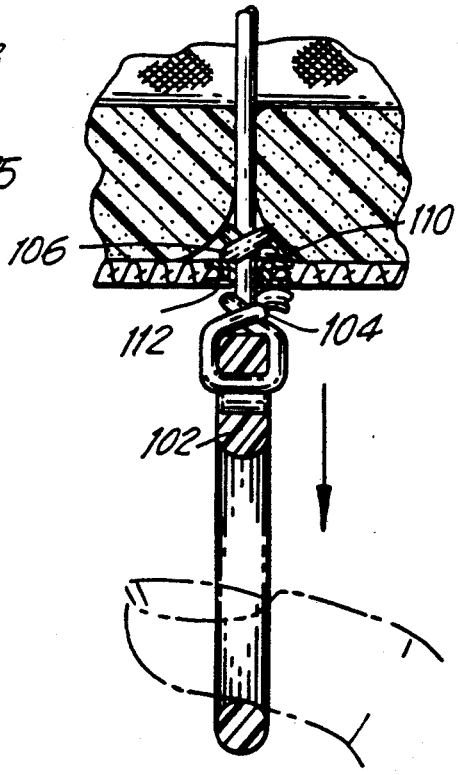

MUSICAL PULL STRING TOY

BACKGROUND OF THE INVENTION

This invention is directed to a musical pull string toy, and, in particular, a musical pull string toy having a unique body and pull string configuration.

Toys have taken many forms in the prior art. Among the popular types of toys are toys that include a music box having a pull string. One such type of pull string toy includes a free form that elongates when the pull string is pulled away from the music box and contracts when the pull string is recoiled into the body. Accordingly, a toy incorporating a pull string music box and wherein the body of the toy has a unique bellows configuration to provide an aesthetically pleasing appearance when the body is extended and contracted by the pull string of a music box is desired.

SUMMARY OF THE INVENTION

Generally speaking, in accordance with the instant invention, a musical pull string toy is provided. The toy includes a fabric body and fabric head sewn together. A music box is disposed within the stuffed head and is positioned therein by stuffing. The music box includes a pull string for producing sound in response to being returned to said music box after being pulled away from said music box. The pull string extends from the music box at the head and extends through the body. The pull string is displaceable between a first predetermined position past which the pull string cannot be returned to the music box and a second predetermined position past which the pull string cannot be pulled from the music box. The body is provided with a bellows region having at least two accordion pleats. The accordion pleats are designed of predetermined similar shapes and each pleat is substantially concentric about the pull string. Accordingly, the structural integrity and hence the substantially similar shape and appearance of the pleats is maintained at all positions of the pull string as it is pulled away from and returned to the music box.

Accordingly, it is an object of the invention to provide an improved musical pull string toy.

A further object of the invention is to provide a musical pull string toy having a body defined by a plurality of pleats.

A still further object of the invention is to provide a musical pull string toy wherein a pleated body maintains its structural integrity and appearance during operation and use.

Yet another object of the invention is to provide an improved musical pull string toy that has a new play value.

Still other objects and advantages of the invention will in part be obvious and will in part be apparent from the specification.

The invention accordingly comprises the features of construction, combination of elements and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description, taken in connection with the accompanying drawings, in which:

FIG. 4 is an elevational view of the musical pull string toy depicted in FIG. 1 in an extended position in accordance with a preferred embodiment of the invention; and FIG. 5 is a sectional view taken along line 5—5 of FIG. 4.

DETAILED DESCRIPTION OF THE PREFERRED EMBODIMENTS

Figure 1:
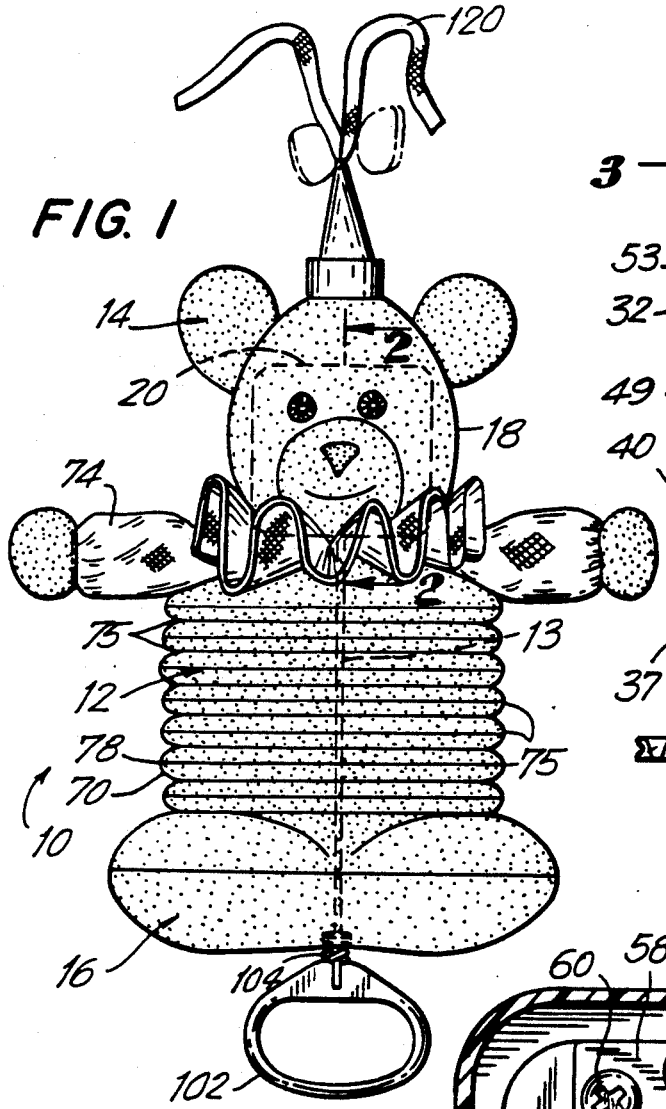
FIG. 1 is an elevational view of a musical pull string toy in a contracted position constructed in accordance with a preferred embodiment of the instant invention.

Reference is now made to the FIGS. 1 and 4 wherein a musical pull string toy, generally indicated as 10, constructed in accordance with the instant invention, is depicted. Pull string toy 10 generally includes a stuffed head, generally indicated as 14, a body generally indicated as 12 and feet, generally indicated as 16. A music box 20 is concealed within stuffed head 14. Music box 20 includes a pull string 13, which extends from head 14 through body 12 and feet 16 and terminates in pull loop 102.

Stuffed head 14, body 12 and feet 16 are formed of a conventional toy outer cover 18 and include stuffing in the head and the feet to maintain the shape thereof. In addition, arms 74 of the body are stuffed in a conventional manner to maintain the shape thereof. Outer cover 18 can be formed of a soft fabric such as terry cloth or the like. Outer cover 18 substantially envelops music box 20. Stuffing 22 is disposed in the head between music box 20 and outer cover 18. Stuffing 22 is conventional such as polyester. In an exemplary embodiment, head 14 is designed in the shape of an animal's head, such as a bear or mouse.

Figure 2:
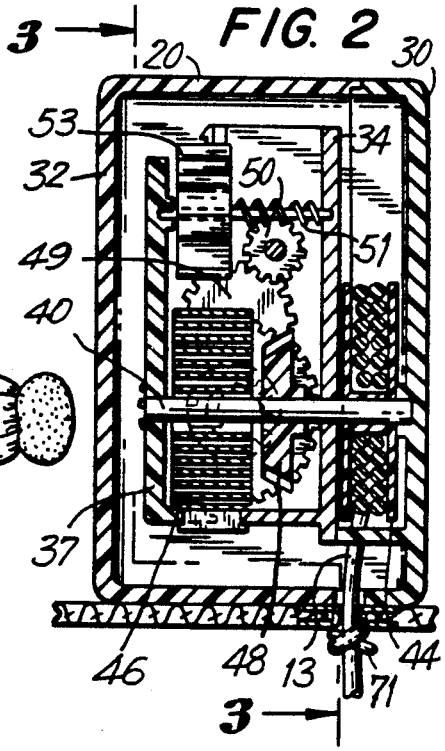
FIG. 2 is a sectional view taken along line 2—2 of FIG. 1.
Figure 3:
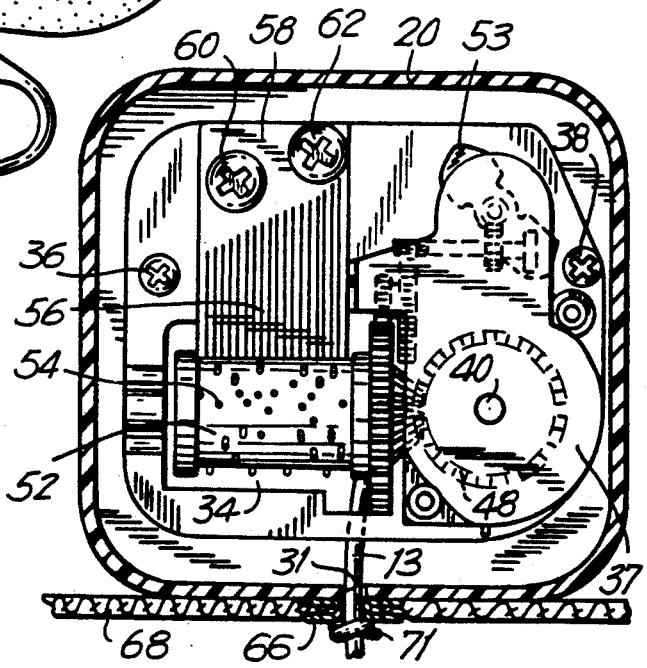
FIG. 3 is a sectional view taken along line 3—3 of FIG. 2.

With particular reference to FIGS. 2 and 3, a conventional pull string music box 20 is depicted. Music box 20 includes a support housing 30 and a housing cover 32. A metal base 34 is mounted to support housing 30 by screws 36 and 38. Coil motor housing 37 is supported on metal base 34. Coil motor housing 37 rotatably supports an axle 40 which is also supported in support housing 30. A wound coil 46 is fixedly supported around axle 40. A right angle gear 48 is fixedly secured to axle 40 and is rotated thereby. A spool 44 is also fixedly mounted on axle 40. Pull string 13 is wound around spool 44 and extends through an eyelet 66 in fabric layer 68. Fabric layer 68 is sewn between head 14 and body 12 and can be formed of seersucker or any other suitable material.

Right angle gear 48 engages a first intermediary gear 49 mounted to base 34, which in turn engages flywheel gear 50, which in turn engages worm gear 51, which supports the flywheel 53. Accordingly, when pull string 13 is pulled away from music box 20, coil spring 46 is wound and as soon as tension is released, coil spring 46 unwinds causing the pull string to be returned in a conventional manner in cooperation between the coil spring and flywheel.

A chime 58 is mounted to base platform 34 by screws 60, 62. Chime 58 includes a plurality of contact keys 56 extending therefrom for making different musical notes when contacted. A drum 52 contains a multiplicity of spikes 54 thereon that contact keys 56 of chime 58 when drum 52 is rotated. Drum 52 is mounted on metal base 34 and is freely rotated in response to the rotation of right angle gear 48 when pull string 13 is returned by coil spring 46 to spool 44. Accordingly, when drum 52 is rotated, spikes 54 contact keys 56 of chime 58 and cause musical notes to be emitted. Spikes 54 are programmed in a conventional manner to play a song familiar to a baby or child.

As noted above, a pull string 13 passes through an opening 31 formed in support housing 30. Pull string 13 then passes through eyelet 66 in fabric layer 68. A first knot 71 is formed in pull string 13 and defines a stop for preventing pull string 13 from being returned into the housing beyond the position of the knot. Knot 71 is positioned a predetermined distance from a further knot 106 disposed in pull string 13 at the inner side of the feet 16. Another knot 104 is spaced outside of the feet and secures pull loop 102 to the pull string 13. As is explained below, knots 71, 104 and 106 define stops that either assist in or prevent the displacement of pull string 13. Pull string 13 is passed through opening 110 formed in outer cover 18. Opening 110 is defined by eyelet 112 which is sewn into the cover of feet 16.

Body 12 is formed of a plurality of accordion pleats 70. In an exemplary embodiment, a multiplicity of "pancake-shaped pleats" having uniformly shaped outer surfaces and aligned opening formed in the center of each pleat 70. The pleats collectively form a bellows region 78. The pleats at their outer edges 75 and inner edges 76. (FIG. 4) could be in any shape such as rectangular, square, oblong or triangular. However, by utilizing pleats in a stack, a certain attractive appearance is provided to the toy body 12.

Knot 106 is formed in pull string 13 inside feet 16 so that feet 16 are moved as a single unit with pull loop 102. Thus, if pull loop 102 is pulled in a direction away from head 14, then feet 16 also move in a direction away from head 14 and cause pleats 70 defining bellows 78 to expand.

This invention provides a head assembly 12 that can be formed with an aesthetically pleasing design and within that design includes a top tie portion 120, which may be formed in a bow as shown in phantom. However, tie portion 120 is provided to allow pull string toy 10 to be secured above a bed or crib by tying a knot. Then, a child may pull pull loop 102 away from head assembly 14 and cause bellows section 78 to expand in the manner depicted in FIG. 4.

When pull loop 102 is pulled away from head assembly 14, pull string 13 causes the string to be placed under tension. After full extension of pull string 13, which is limited by the length of the string, coil 46 of the music box causes pull string 13 to be retracted into the music box and also causes a melody to be played in the manner discussed above. Accordingly, string 102 slowly retracts back to the first position as shown in FIG. 1, while a melody is played. The retraction of the string is limited by first knot 71 so that the pleats are not crushed.

It is noted that string 13 is designed such that when pull loop 102 is pulled away from head 14, knot 106 causes feet 16 to move with pull loop 102. When pull string 13 is completely retracted, a predetermined length of string is always maintained between knot 71 and knot 104 so that pull string 13 does not force the toy body to contract too far and be compressed and hence distorted. Accordingly, when pull string toy 10 is in a first predetermined position, the pleats 70 of body assembly 12 maintain their structural integrity and the music box rewind mechanism does not cause pull string 13 to deform the shape of body assembly 12. Furthermore, when pull loop 102 is completely pulled away from head assembly 14, because of the predetermined length of pull string 13, pull string 13 stops before bellows region 78 begins to pucker or deform. Accordingly, this invention provides enhanced play value for a user because the toy body is formed with a plurality of pleasantly shaped accordion pleats and the pull string is provided to extend and retract a predetermined distance such that the structural integrity of the toy body is maintained throughout the entire movement of the music box pull string.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A musical pull string toy comprising:

a toy body having at least a stuffed head and a body;

sound generating means disposed in said head, said sound generating means including a pull string; said pull string extending from said head and through said body and being extendably displaceable between a first predetermined position past which said pull string cannot be retracted and a second predetermined position past which said pull string cannot be unwound, said sound generating means producing sound in response to said pull string being returned to said first position;

said toy body having a bellows region defined by at least two accordion pleats, each pleat being substantially concentric about said pull string when said pull string is extended to said second predetermined position, so that said pleats are minimally distorted at any positions of said pull string.

2. A musical pull string toy as claimed in claim 1, wherein said pull string is of a predetermined length which defines the second predetermined position past which said pull string cannot be unwound.

3. A musical pull string toy as claimed in claim 1, wherein said pull string exits said body at a position that is distally located from said head, said pull string including a first stop means positioned inside the body at the position at which said pull string said body, said stop means causing said body to extend when said pull string is pulled away from said head.

4. A musical pull string toy as claimed in claim 3, wherein said pull string includes a second stop means disposed inside said body, said second stop means defining said predetermined position beyond which said pull string cannot be retracted.

5. A musical pull string toy as claimed in claim 4, wherein said second stop means is positioned a predetermined distance from said first stop means and said first stop means is located at a position distal from said sound generating means.

6. A musical pull string toy as claimed in claim 1, wherein said pull string includes a stop means positioned exterior to said body at a position distally located from said head, said stop means causing said body to be contracted when said pull string is retracted.

7. A musical pull string toy as claimed in claim 1, wherein said sound generating means is a music box.

8. A musical pull loop string toy as claimed in claim 3, further including a pull loop coupled to said pull string at a point distal from said sound generating means.

9. A musical pull string toy as claimed in claim 8, and including fastening means located at a position opposite said pull loop means for maintaining said stuffed head stationary.

10. A musical pull string toy as claimed in claim 1, wherein said sound generating means includes means for recoiling said pull string.

11. A musical pull string toy as claimed in claim 1, wherein said bellows section includes six accordion pleats.

12. A musical pull string toy as claimed in claim 1, having outer surface at least partially formed of terry cloth.

13. A musical pull string toy as claimed in claim 1, wherein said second predetermined position is less than twice the length of said first predetermined position.

14. A musical pull string toy as claimed in claim 1, wherein said stuffed head includes an outer cover and said sound generating means, and stuffing material is disposed between said outer cover and said sound generating means for stabilizing the position of said sound generating means in said head.

15. A musical pull string toy as claimed in claim 1, further including stuffed simulated feet sewn to said body, said pull string extending from said head, through said body and through said feet.

16. A musical pull string toy as claimed in claim 1, wherein each of said pleats has a similar shape.

17. A musical pull string toy as claimed in claim 1, further including a pull loop coupled to said pull string at a point distal from said sound generating means.

* * * * *